United States Patent [19]

Renoux

[11] 3,955,524

[45] May 11, 1976

[54] TOWABLE FLEXIBLE MARINE TRAILER

[76] Inventor: Charles Simon Renoux, Chemin-des-Bellons, Les Bellons, 13190 - Allauch, France

[22] Filed: Oct. 16, 1974

[21] Appl. No.: 515,345

[30] Foreign Application Priority Data

Oct. 19, 1973 United Kingdom ..... 48891/73

[52] U.S. Cl. ..... 114/74 T

[51] Int. Cl.[2] ..... B63B 25/14

[58] Field of Search ..... 114/74 R, 74 T, .5 T, 114/68, 69, 235 B; 137/571, 572, 576, 517

[56] References Cited

UNITED STATES PATENTS

| | | | |
|---|---|---|---|
| 3,779,196 | 12/1973 | Knaus et al. | 114/74 T |
| 3,794,077 | 2/1974 | Fanshier | 137/517 |
| 3,797,445 | 3/1974 | Zeimer | 114/74 T |
| 3,844,239 | 10/1974 | McLaughlin et al. | 114/74 R |

FOREIGN PATENTS OR APPLICATIONS

| | | | |
|---|---|---|---|
| 824,984 | 4/1958 | United Kingdom | 114/74 T |

*Primary Examiner*—Trygve M. Blix
*Assistant Examiner*—Stuart M. Goldstein
*Attorney, Agent, or Firm*—Bacon & Thomas

[57] ABSTRACT

A marine trailer comprising an elongate collapsible, flexible container and at least one open-ended rigidifying conduit of a flexible-walled construction extending along the container with the cross-sectional area of the conduit decreasing from the front towards the rear of the container. Thus ambient liquid enters the conduit and, on flowing therethrough, exerts a pressure on the flexible wall of said conduit which is greater than the external pressure.

The trailer may also have a safety reservoir which is disposed at the rear end of the container and is automatically communicable with the container in the event of rupture of the container.

15 Claims, 17 Drawing Figures

44b
59
56
38
60
44b
40
37a
41
37
IX
IX
39b
39a
33
43
55
26
24
23
25
VIII
VIII
34
34
36
36a
29
32

59
59
41
40
38
44
56
24
37
42
43
39a
44a
28
23
25
26
27
36
32
29

TOWABLE FLEXIBLE MARINE TRAILER

The present invention relates to a marine trailer of flexible construction for transporting a fluid such as naphtha, petroleum or oil, on a liquid medium.

Such a trailer can, for example, be used to transport, by means of a towing boat, crude petroleum by sea or by river, between a supply site and a site where the crude petroleum is to be treated, and to store this petroleum.

Floating trailers comprising a container which is made of flexible material and is thus pliable when empty are already known for transporting fluids on a liquid medium. The known floating trailers are generally insufficiently rigid when they are filled, and this manifests itself in undulations or bending movements of the trailer during towing, especially at sea. The undulations and bending movements are caused, during towing, by the liquid medium surrounding the trailer and possibly by the towing action and inertia movements of the cargo. These undulations and bending movements can cause severe damage to the container and make it difficult to control. Moreover, the container can also be seriously damaged if it should come into contact with solid objects which can be present in the liquid medium. When this damage results in tearing or piercing of the container, the cargo disperses into the liquid medium and pollutes it.

The main aim of the present invention is to overcome the disadvantages mentioned above and to provide a flexible trailer which has sufficient rigidity during towing to prevent undesirable undulations and bending movements of the container, and thus to facilitate this towing process.

According to the present invention there is provided a marine trailer comprising a container which is made of flexible material and has an elongated shape in the filled state, and at least one conduit which has walls made of flexible material and extends along and outside said container with the conduit transverse cross-section decreasing from the front towards the rear of the said container, the or each conduit being open at its end situated near the front of said container and having at least one outlet orifice. The ambient liquid medium in which the trailer is being towed can then flow through the or each conduit so as to generate an internal pressure therein greater than the external pressure exerted on the exterior of the trailer by the surrounding liquid medium. Thus the or each such conduit is made rigid during the towing process due to the difference between the internal and external pressures acting on its wall separating it from the surrounding liquid medium, thus preventing undesirable undulations and bending movements of the trailer.

Preferably the trailer may include several such conduits made of flexible material and extending along the container and distributed uniformly outside and around the said container, the various conduits being open at both their ends and being firmly fixed to the outer wall of said container.

Alternatively the trailer may include at least one jacket made of flexible material coaxial with and surrounding the container such that the or each jacket together with the said container delimits an annular space which has open ends in the vicinity of the front and rear of the container.

Advantageously, the trailer may have a safety reservoir made of flexible material which can communicate with the said container via a pipe equipped with at least one valve, and pressure-sensitive detection means capable of detecting a pressure drop in the said jacket and of controlling the opening of the said valve in order to transfer cargo fluid from the container along the said pipe to the safety reservoir. Due to this device, the cargo fluid present in the container is prevented from dispersing into the surrounding liquid medium as a result of an accidental tear or a puncture in the wall of the container. When the fluid is, for example, crude petroleum which is being transported by sea, undesirable accidental pollution of the marine environment is thus prevented. In order that the present invention may more readily be understood the following description is given, merely by way of example with reference to the accompanying drawings in which:

Figure 1:
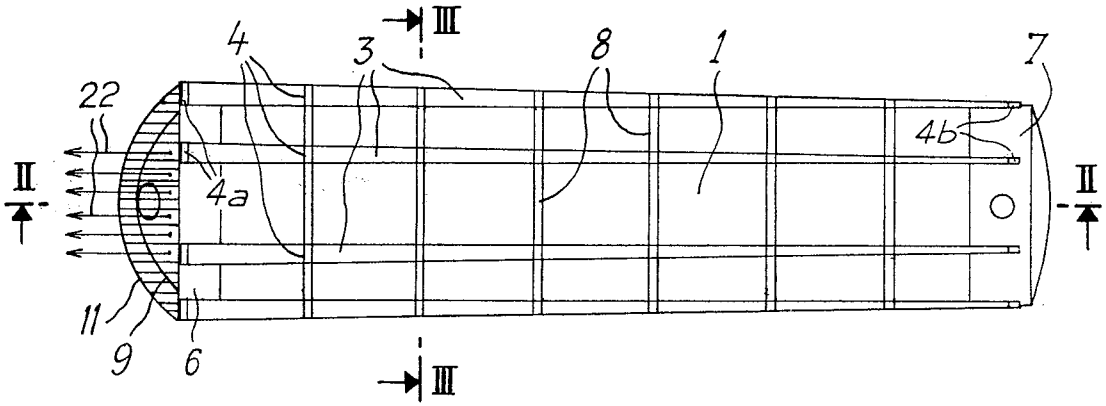
FIG. 1 is a diagrammatic plan view of a first embodiment of a marine trailer according to the invention.
Figure 2:
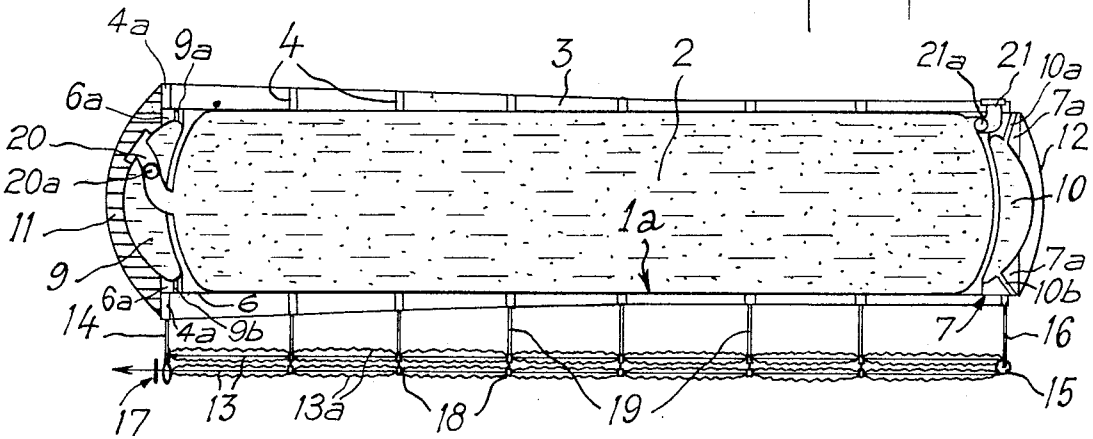
FIG. 2 is a side elevational, partly sectional view taken along the line II—II of FIG. 1.
Figure 3:
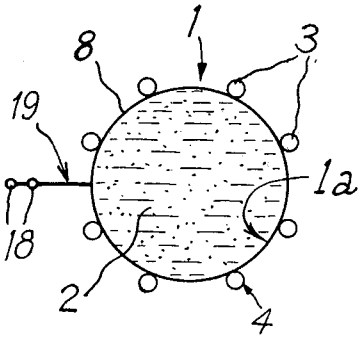
FIG. 3 is a transverse sectional view along the line III—III of FIG. 1.

FIGS. 1 to 3 illustrate diagrammatically a first embodiment of a trailer according to the invention, comprising a container 1 whose cylindrical wall 1*a* is made of flexible material, for example a plastics material. The container 1 is shown filled with a cargo fluid 2, and has its internal volume optionally divisible into two compartments by means of partitions, for example transverse partitions.

Conduits 3 also made of flexible material, for example a plastics material, are positioned around the container 1, longitudinally and externally relative to the latter. The tubular conduits 3 are open at both ends and extend over substantially the whole length of the container 1, with their transverse cross-section decreasing gradually from the front towards the back of the container 1 (i.e., from left to right in FIG. 1). The conduits 3 are preferably distributed uniformly around the circumference of the cylindrical container 1 and are firmly fixed to the container, for example by welding to the wall 1*a*.

The conduits 3 are equipped with transverse rigidifying rings 4 firmly fixed to the wall of each conduit and distributed thereafalong, two of these rings 4*a* and 4*b* defining respectively the front and back openings of the respective conduits.

The container 1 is also itself equipped with transverse and rigidifying rings 6 and 7 and transverse intermediate rigidifying rings 8 firmly fixed to the wall 1*a*. The rings 6 and 7 are positioned respectively at the front end and at the rear end of the container 1 and their axial dimension or width is substantially greater than that of the intermediate rings 8 distributed along the container. The arrangement of the rings 4*a*, 4*b* and 4 provided on the walls of the conduits is such that they are respectively on an axial level with rings 6, 7 and 8 with which the wall of the container 1 is equipped.

The end rigidifying rings 6 and 7 protrude beyond the front and rear ends of the container 1 and support water-ballast tanks 9 and 10, placed at the front and at the back of the container 1, by means of rigid arms 6*a* and 7*a* which extend radially between the rings 6 and 7 and the rigid walls of the water-ballast tanks 9 and 10, and which are attached to the inner surface of the rings 6 and 7 and to the radially outer surface of the circular water-ballast tanks 9 and 10. The water-ballast tanks 9 and 10 are equipped with air vent tubes 9*a* and 10*a* and with water vent tubes 9*b* and 10*b*. Furthermore, at their lower part, the rings 6, 7 and 8 are provided with ballasting (not shown) so as to provide the trailer with the desired stability and the desired inclination.

At the front the trailer is equipped with a fish screen or net 11, attached to the end rings 4*a* and 6. At its back the trailer is optionally equipped with a closing plate 12 attached to the end ring 7. The trailer has several, generally at least three, cable systems distributed uniformly around its periphery and extending along the container to keep its length constant during towing. Only one of these cable systems is shown in FIG. 2 and comprises a cable 13 which is attached at one of its ends to a point of attachment on a rod 14 carried by the front end ring 6, is wound around a return pulley 15 attached to a rod 16 carried by the rear end ring 7, and is attached at its other end to an adjustable stop 17 which engages the rod 14. Along its path, the cable 13 passes through guide rings 18 attached to rods 19 carried by the intermediate rigidifying rings 8 of the container. The cable 13 is preferably surrounded by a protection sheath 13*a*. Such cable systems make it possible to facilitate the folding and, where appropriate, the discharging of the trailer.

When the trailer is being stored, or when it is being transported in the empty state, it is folded up like an accordion in that the portions of the flexible wall 1*a* of the container and the parts of the flexible walls of the conduits 3 situated between the adjacent rigidifying rings are folded like bellows. To enable it to be filled and discharged, the container 1 has conduits 20 and 21 which are equipped with shut-off valves 20*a* and 21*a* and which open at the front and at the back of the container. Where the container is divided into compartments, each of these compartments will of course be equipped with its own filling and discharging conduits. The operation of the valves 20*a* and 21*a* as well as the filling of the water-ballast tanks 9 and 10 are controlled from the towing boat by pneumatic means not shown.

When the trailer is being towed in a liquid medium, for example by means of towing cables 22 (shown only in FIG. 1) attached to the front of the trailer, some of the ambient liquid medium such as sea water flows through the conduits 3 from the front towards the back of the container. Since the cross-section of these conduits decreases from the front towards the back the liquid flowing through them, having a constant mass flow rate along each conduit, generates an internal pressure therein greater than the external pressure exerted on these same conduits by the surrounding liquid medium with the result that the conduits 3 are made rigid during towing and, since they are attached to the wall 1*a* of the container 1, they define together with the rigidifying rings on the wall a rigid structure suitable for preventing any undesirable undulation or bending movement of the trailer.

Figure 4:
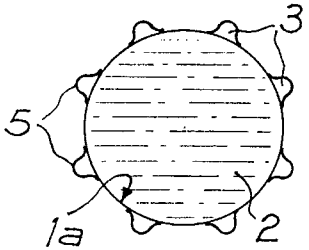
FIG. 4 is a diagrammatic view in transverse cross-section of a variant of the embodiment of FIGS. 1 to 3.

FIG. 4 shows in transverse cross-section a variant of the first embodiment described above, differing therefrom essentially in the structure of the rigidifying conduits 3. These are defined, on the one hand, by longitudinal portions of the outer surface of the wall 1*a* of the container 1, and on the other hand, by strips 5 of flexible material extending along the length of the container and curved over transversely along their entire length by being attached, for example welded, by their edges to the wall 1*a* so as to define conduits 3 which are open at both their ends and have their transverse cross-section decreasing towards the back of the container. In this case, it is possible either to equip the container 1 and the conduits 3 with common transverse rigidifying rings whose shape follows the cross-section of the outer perimeter of the assembly of container 1 and strips 5, or to equip the container 1 with transverse rigidifying rings and to provide, on the same axial level as these, rigid hoops on the strips 5.

Although conduits 3 which are open only at their front and rear ends have been described and represented, it is also possible for the container 1 to be equipped with conduits of decreasing cross-section, which are each open at the front end and have, instead of an opening at the rear end, a plurality of orifices of small cross-section distributed over their entire length. This arrangement makes it possible to prevent the appearance of objectionable turbulence phenomena which can occur at the rear opening of the conduits 3.

FIGS. 5 to 11 illustrate a second embodiment of a trailer according to the invention. This trailer comprises a container 23 of flexible material, for example a plastics material, which is shown in FIGS. 5 to 9 in its extended state and filled with a cargo fluid 24. The container 23 can optionally be partitioned inside so as to define several separate compartments. The container 23 is of cylindrical shape and surrounded by a flexible tubular jacket 25, having transverse rings 26 made of a rigid material, for example a plastics material.

Towards the front of the trailer (i.e., the left in FIG. 5), the jacket 25 ends in a rigid front end ring 27 and a fish screen such as a net 29. Towards the rear of the trailer, the jacket 25 ends in another rigid rear end ring 28. The flexible jacket 25 and its various rigidifying rings 26, 27 and 28, together with the outer surface of the container 23, define an annular passage 30 whose transverse cross-section decreases from the front towards the rear of the container 23. This annular passage 30 is open at both its ends and at the front of the container 23 the opening 30*a* is of annular shape delimited externally by the end ring 27 and internally by a rigid water-ballast tank 32 situated at the front of the container 23, and covered by the fish screen 29. At the rear of the container, the opening is in the form of several orifices 30*b* equiangularly distributed around the rear part of the container 23, and communicating with the ambient liquid medium such as water.

Figure 6:
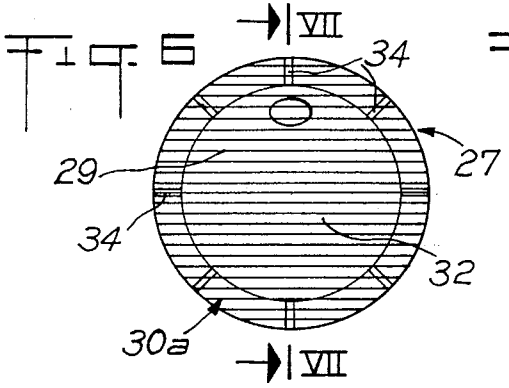
FIG. 6 is a diagrammatic front view of the trailer illustrated in FIG. 5.
Figure 11:
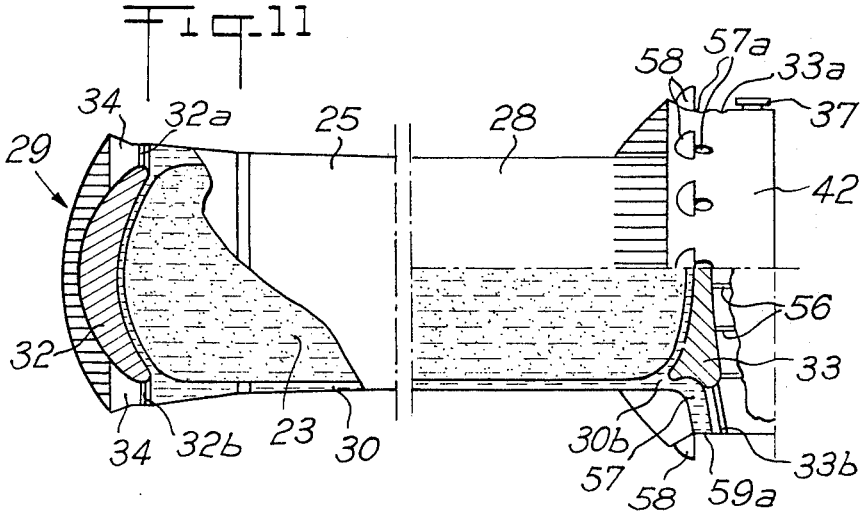
FIG. 11 is a partial detailed diagrammatic view of the marine trailer illustrated in FIGS. 5 to 10.

FIG. 11 illustrates in a more detailed manner the front of the container 23 in side elevation with part of the jacket 25 cut away, and the rear of the container 23 having its lower half in longitudinal cross-section through the middle. At the front of the container 23, there is positioned a rigid water-ballast tank 32 held by radial rigidifying arms 34 which are firmly fixed to the outer wall of the water-ballast tank 32 and the end ring 27. The arms 34 also assist in defining the annular opening 30*a* of the passage 30 (FIG. 6). The water-ballast tank 32 is equipped with vent tubes 32*a* and 32*b* for air and water, respectively.

At the rear of the container 23 there is positioned a rigid water-ballast tank 33 which is held by radially extending rigidifying tubes 57 (shown only in FIGS. 9 and 11) which are of rigid construction and communicate the openings 30*b* with the exterior of the trailer. The water-ballast tank 33 is equipped with vent tubes 33*a* and 33*b* for air and water, respectively. When the trailer is being towed in a liquid medium, a portion of this liquid medium flows through the annular passage 30 from front to rear of the container 23. In order to avoid exerting an objectionable braking effect on the liquid escaping through the orifices 30*b*, it is advantageous for the total cross-section through which the liquid escapes at the rear of the container 23 to be substantially constant, for example, equal to the cross-section of the rear end portion of the annular passage 30 (at the level of the line IX—IX of FIG. 7). To achieve this, the rigid tubes 57 which communicate the openings 30*b* and the exterior of the container have a constant cross-sectional area in the direction of flow of the liquid passing through them. When the rear of the trailer is the rear of the container 23, the rigid tubes open at the rear of the trailer, around the water-ballast tank 33, so that the liquid escapes from these tubes along a direction which is substantially opposite to the towing direction. However when, for example, the trailer is equipped with a safety reservoir positioned directly behind the container 23, in a way which is described later, it is necessary to make the tubes 57 open at the periphery of the trailer, for example on a level with the outer surface of a rigid ring 42. At the outer surface of the said ring, the liquid discharges from the openings 57*a* of the tubes 57 and, in order to prevent objectionable turbulence phenomena, the ring 42 carries hoods 58 which shield the openings 57*a* and deflect the flow of liquid discharging from these openings towards the rear of the trailer.

The rigid rings 26, 27 and 28 have, at their lower part, ballasting 35 (FIG. 5) calculated so as to impart to the trailer the desired stability and the desired inclination. The container 23 has conduits 36 and 37 (FIG. 7) at its front and rear ends. The filling pipe 36, situated at the front of the container 23, is surrounded by the water-ballast tank 32 and is equipped with a shut-off valve 36*a*. The discharge pipeline 37, situated at the back of the container 23, is equipped with a valve 37*a*. The valves 36*a* and 37*a* are normally closed during towing.

When the trailer is being towed in a liquid medium by means of towing cables 31 (shown only in FIG. 5) attached at the front of the trailer to the end ring 27, the liquid flowing in a backward direction through the annular passage 30 of decreasing cross-section generates an internal pressure inside this space which is greater than the external pressure exerted on the jacket 25 by the surrounding liquid medium. As a result of this, the jacket 25 is kept spaced apart from the container 23 and has sufficient rigidity to prevent undesirable undulations and bending movements of the trailer. Moreover, the jacket 25, being pressurised, behaves like a pneumatic cushion protecting the container 23. In the eventuality of the jacket 25 alone being damaged by a puncture or a relatively small tear, the water will flow through this puncture or tear because of its greater pressure, but the jacket 25 will be kept apart from the container 23 which will still be protected.

Despite the protection provided by the jacket 25, an accidental puncture or tear can occur, seriously damaging the jacket 25 and possibly the container 23. Thus, the trailer according to the invention is advantageously equipped with a safety reservoir 38 communicating with the back of the container 23 via a conduit 39 equipped with valves 39*a* and 39*b*. The reservoir 38 is a cylinder of flexible material which like the container 23, is surrounded by a jacket 40 also made of flexible material, the jacket 40 having rigid rings 41 distributed along its length. The reservoir 38 has a capacity greater than that of the container 23; for example, it has a larger transverse cross-section. At its front part, the jacket 40 of the safety reservoir has a rigid end ring 42 which is extended by a fish screen or net 43, attached to the periphery of the rear end ring 28 of the main container. The jacket 40, together with the reservoir 38, defines an annular space 44 whose transverse cross-section decreases from the front towards the rear of the reservoir 38. The annular space 44 is open at both its ends. At the front of the reservoir 38, the annular space 44 has an annular opening 44*a* delimited by the rigid end ring 42 of the jacket 40 and the rigid end ring 28 of the jacket 25, and covered by the fish screen 43. At the rear of the reservoir 38, the annular space 44 (FIG. 9) has orifices 44*b* which are equiangularly distributed about the trailer longitudinal axis and are extended by rigid tubes 59 which surround and hold a water-ballast tank 60 positioned at the rear of the reservoir 38. The tubes 59, like the tubes 57, are dimensioned such that no braking effect is exerted on the liquid flowing therethrough.

Figure 5:
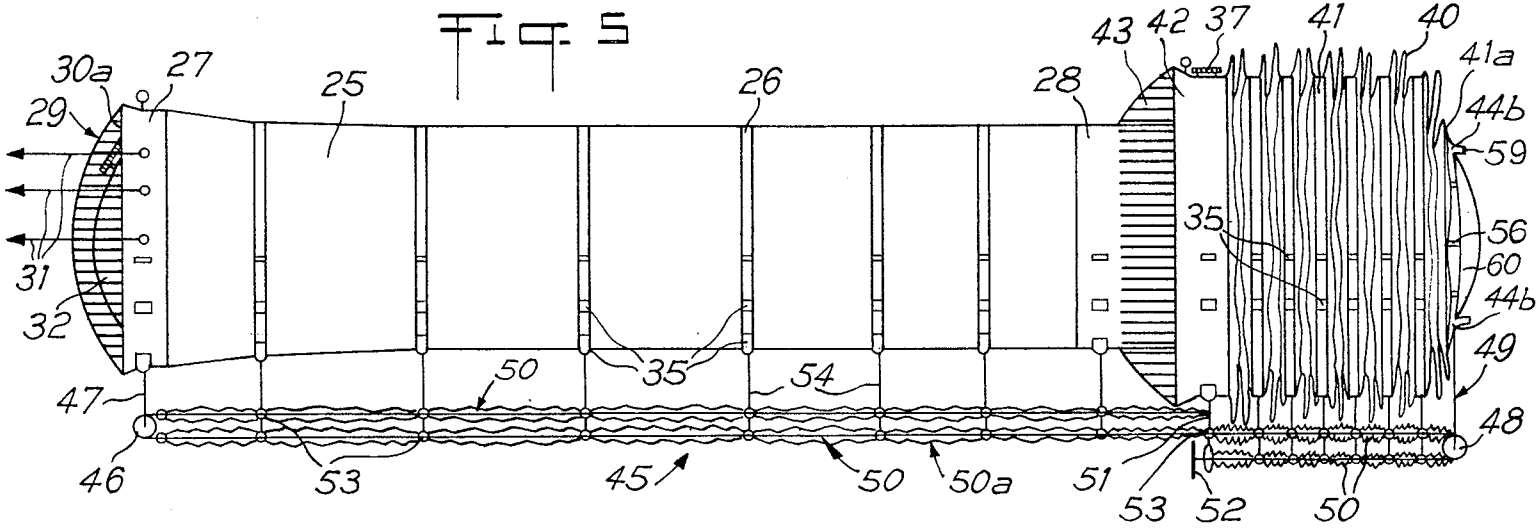
FIG. 5 is a diagrammatic view in elevation of a second embodiment of marine trailer according to the invention.
Figure 9:
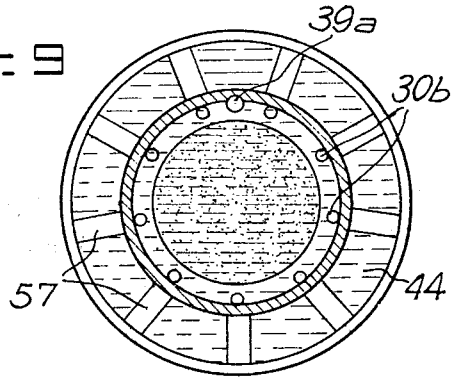
FIG. 9 is a transverse sectional view along the line IX—IX of FIG. 7.
Figure 8:
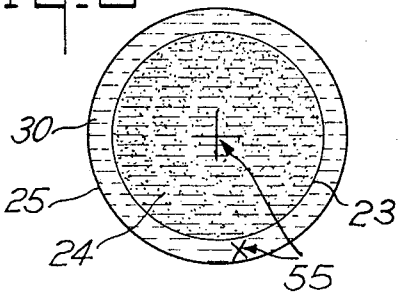
FIG. 8 is a transverse sectional view along the line VIII—VIII of FIG. 7.

The rings 41 and 42 with which the jacket 40 is equipped carry ballasting 35 in a similar manner to the rigid rings 26, 27 and 28 of the jacket 25 (FIG. 5). Several, and in general at least three, cable systems such as 45, distributed uniformly around the trailer, are connected to the rings 26, 27, 28, 41 and 42 and operate in the same way as cable system 13 of FIG. 1. For example each of the cable systems 45 (represented only in FIG. 5) has a front pulley 46 mounted on a rod 47 attached to the front end ring 27 of the jacket 25, and a rear pulley 48 mounted on a similar rod 49 attached to the rear rigid end part 41*a* of the reservoir jacket 40. A cable 50, attached at one end to a rod 51 carried by the front end ring 42 of the reservoir jacket 40, passes forwardly, then over the front return pulley 46 and then over the rear return pulley 48 to be attached at its other end to an adjustable stop 52 abutting the rod 51. This adjustable stop 52 can be controlled pneumatically either under control from the towing boat, or automatically from a safety source of fluid under pressure in the eventuality of complete rupture of the connections between the towing boat and the trailer. Although the construction of the cable system described above is preferred because it is similar both with respect to the container and to the reservoir, it is perfectly possible to position the adjustable stop 52 at the rear of the trailer, by attaching it to the rod 49. The cable 50 is guided along its path by rings 53 carried by rods 54 attached to the rigid rings of the jackets 25 and 40. The cable 50 is preferably covered with a protecting sheath 50*a*.

The cargo liquid 24 is transferred from the container 23 to the reservoir 38, in response to the detection of a wide puncture or tear in the jacket 25 and possibly in the wall of the container 23 resulting in a reduction of pressure in the passage 30 and in the container. For this purpose, pressure-sensitive detectors such as manometers or piezometers 55 (FIGS. 7 and 8) are positioned inside the container and on the outer wall of the container 23 in the annular passage 30, and are connected to a control circuit (not illustrated) which effects pneumatic control of the valve 39*b*. Normally, during towing, the valve 39*a* is open, the valve 39*b* is closed, and the trailer is in the configuration illustrated in FIGS. 5 and 7, that is to say the container 23 is full and has its elongate shape and the reservoir 38 and the jacket 40 are folded like an accordion and kept thus by means of the adjustable stop 52 of the cable system 45.

Figure 7:
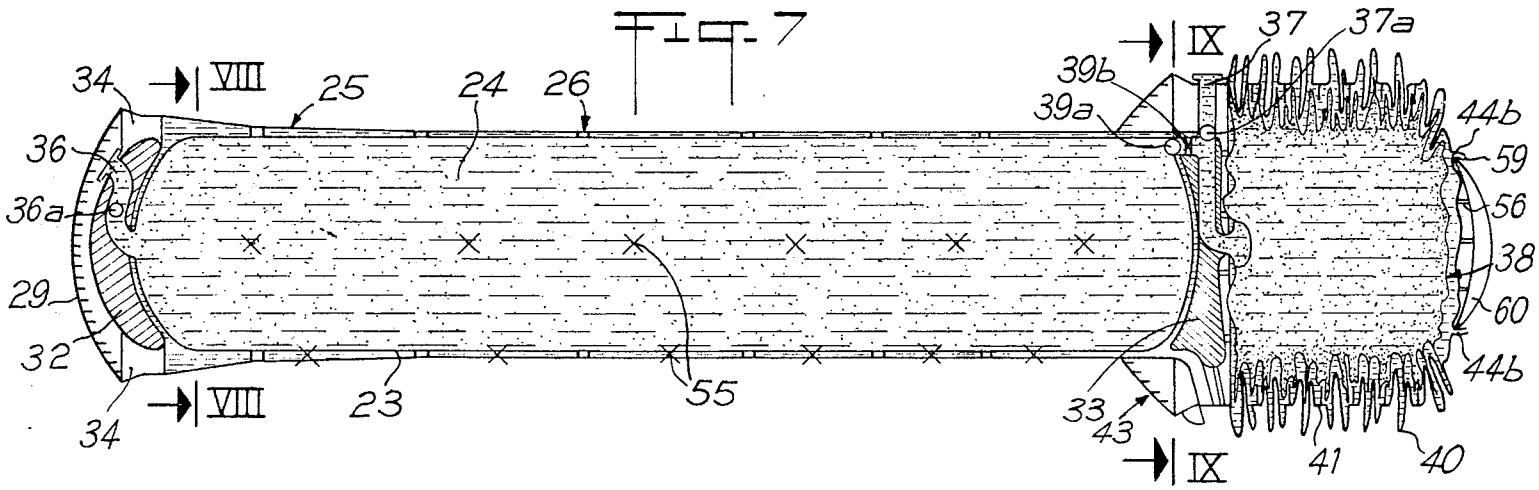
FIG. 7 is an elevational, partly sectional view taken along the line VII—VII of FIG. 6.
Figure 10:
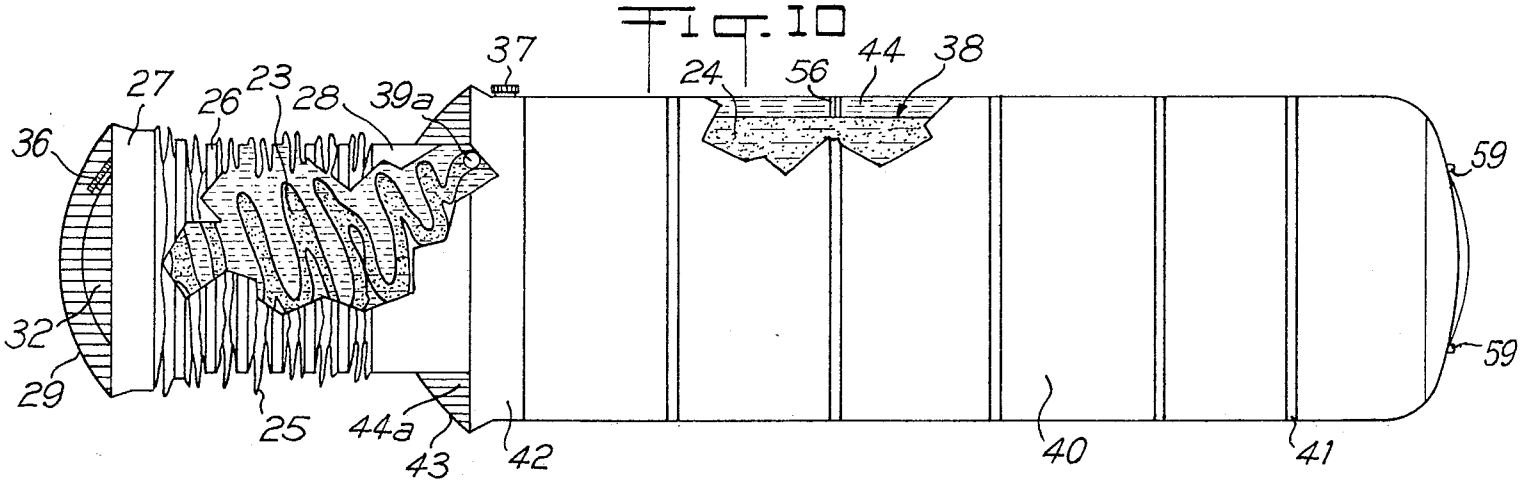
FIG. 10 is a diagrammatic view in elevation and in partial cross-section of the trailer after the cargo liquid has been transferred from the container to the safety reservoir.

If a wide puncture or tear occurs in the jacket 25, the resulting reduction in pressure in the passage 30 is detected by the manometers 55 which then control the opening of the valve 39*b*. Provided the other valve 39*a* is already open, the cargo liquid 24 present in the container 23 then passes through the conduit 39. The surrounding liquid entering through the annular opening 44*a* of the annular space 44 constantly tends to unfold the reservoir 38 and, via the cable systems 45, to fold the container 23 like an accordion, the total length of the trailer being kept substantially constant by the cable 50. Since the reservoir 38 is larger than the container 23, the fluid 24 is sucked into the reservoir 38 and, moreover, the water present in the annular passage 30 between the jacket 25 and the container 23 tends to expel the liquid 24 from the container 23. Flexible plastics attachments of constant length such as 56 (FIG. 10), which are preferably attached to the rigid rings 41 of the jacket 40 and are positioned radially between the jacket 40 and the outer wall of the reservoir 38, can be provided to keep the jacket 40 apart from the reservoir 38 and to facilitate correct unfolding of the jacket 40 and reservoir 38 when the reservoir is being filled. When the fluid 24 is completely transferred to the reservoir 38, the trailer is as illustrated in FIG. 10, and the reservoir jacket 40 is pressurised, protecting the reservoir 38. The attachments 56 keep the reservoir 38 apart from the water-ballast tanks 33 and 60 (FIGS. 11 and 7).

Figure 12:
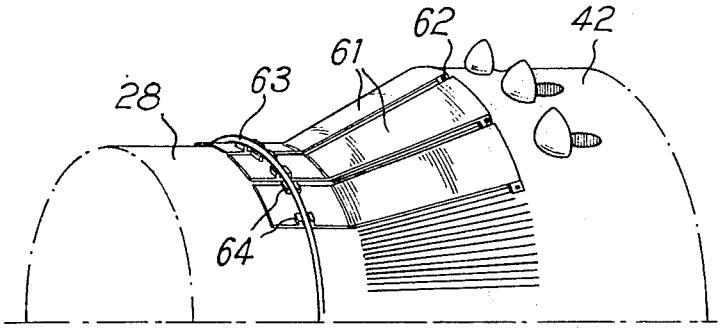
FIGS. 12 and 13 show diagrammatically a special device provided at the joint between the container and the reservoir of the trailer of FIGS. 5 to 11.
Figure 13:
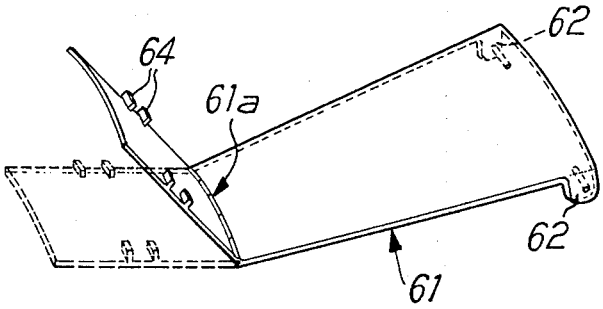

When the container 23 is full, the reservoir 38 and its jacket 40 will have been folded so that the liquid tending to enter through the annular opening 44*a* during towing has a tendency to exert a braking effect on the latter. Thus, this annular opening 44*a* can be sealed to a large extent by a special device as illustrated in FIGS. 12 and 13.

This device has several semi-rigid sealing plates 61 hinged at one end to the end ring 42 by means of hinges 62 and held at the other end on the end ring 28 by a strap 63. The sealing components 61 are distributed at the periphery of the rings 28 and 42, partially covering the fish screen net 43, and closely peripherally spaced. Each sealing plate 61 is equipped with claws 64 to receive the strap 63, and is folded along a line 61*a* so that, in the free state, a sealing plate has the V-shape illustrated in FIG. 13.

When a wide tear in the jacket 25 is detected, the pneumatic control circuit associated with the manometers 55 also actuates loosening of the strap 63 and the front part of each sealing plate springs up, under the effect of the elasticity of the plate 61, so that the sealing plates 61 assume their V-shape. Under the effect of the total pressure of the liquid medium then exerted in opposition to the sealing plates 61, the plates all pivot about their rearward hinges 62 and completely free the opening 44*a* of the space 44, thus making it possible for the water entering through this space to make an effective contribution towards the unfolding of the safety reservoir. It is preferable not to seal the opening 44*a* completely by means of the sealing plates 61 so that, if necessary, the unfolding of the safety reservoir is begun as rapidly as possible.

As represented in FIGS. 5, 7 and 10, the container 23 and the reservoir 38 are disposed coaxially, and the reservoir 38 has a larger cross-section than the maximum cross-section of the jacket 25 surrounding the container 23 in order to ensure that the annular opening 44*a* of the reservoir annular space 40 is not sealed by the container and the folded jacket 25. The container, the reservoir and their respective jackets can be folded like an accordion when the trailer is empty and then form bellows between the rigid rings with which the jackets are equipped. The trailer can be stored and transported in the folded state, held by the cable systems 45 which are then loosened when the trailer is placed in the water, it being possible for the trailer to be placed in the water by means of lifting machinery such as a crane.

The container 23 is filled by means of a feed tube connected to the filling pipe 36 while the valve 36*a* is open and the valves 37*a*, 39*a* and 39*b* closed. After filling the container 23, the valve 36*a* is closed and the water-ballast tanks are filled so as to immerse the trailer. The adjustable stops 52 for the cables are adjusted so as to stretch the cable 50. The trailer is then towed and, when the rate of towing reaches a certain value such that pressurisation of the jacket 25 is achieved, the valve 39*a* is opened and this leaves the passage between the container 23 and the reservoir 38 under the sole control of the valve 39*b* which is operable under the control of the circuit linked to the manometers 55. Before arrival at the unloading point, in order to prevent inadvertent transfer of the cargo liquid from the container 23 to the reservoir 38 due to the decrease in pressure in the annular passage 30 as a result of the sudden slowing down of the trailer, the valve 39*a* is closed. The cargo is unloaded via the filling pipe 36 while the valve 36*a* is open and the valves 37*a* and 39*a* closed. The unloading operation can be facilitated by traction exerted in the cable systems 45. In order to be able to pump the cargo liquid at least one rigid zig-zag tube connected to the pipeline 36 is positioned at the base of the container 23. So that it can be folded, this zig-zag tube is formed from rigid portions connected by bends made of non-rigid material, for example a plastics material, the cross-section of these bends being kept circular by means of rigid rings. At least one similar zig-zag tube is positioned in the reservoir 38 and is connected to the pipe 37. If the container and the reservoir are divided into several compartments, these zig-zag tubes are equipped with valves which can be actuated, for example pneumatically, in order to pump the liquid from each compartment separately. The operation of the valves 36*a*, 37*a* and 39*a* as well as the filling of the ballast tanks 32 and 60 are controlled from the towing boat by pneumatic means (not shown).

The operations of loading and unloading the trailer of FIGS. 1 to 4 are similar to those described above and a zig-zag tube is positioned at the base of the container 1.

FIGS. 14, 15, 16 and 17 illustrate particular embodiments of components which form a trailer according to the invention.

Figure 14:
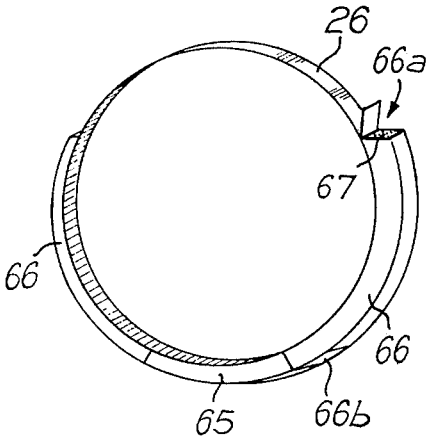
FIG. 14 is a diagrammatic view of a particular embodiment of the ballasting of a trailer according to the invention.

FIG. 14 illustrates a particular embodiment of ballasting provided on the rigid rings 8 of the container 1 of FIG. 1 and ballasting 35 provided on the rigid rings of the jackets 25 and 40 of FIG. 5. It appears, in fact, that the total weight of ballast necessary to immerse a trailer according to the invention varies as a function of the cargo fluid and of the specific gravity of the liquid medium (e.g., water) in which the trailer is immersed. In the case of crude petroleum transported by sea, this weight of ballast can vary between 5 and 27% of the weight of the cargo liquid, this being due to variations in the specific gravity of crude petroleum depending on its origin and on specific gravity variations due to the degree of salinity and the temperature of the sea water. Because of this, it is advantageous to be able easily to change the weight of the ballast attached to the rigid rings 8, 26, 27 and 28 or 41, 41*a* and 42 and this can be achieved by means of the ballasting device illustrated in FIG. 14.

This device comprises a fixed ballast 65, attached to the underside of a rigid ring, for example ring 26, and two sausage-shaped containers 66 which are attached to the periphery of the ring on either side of the fixed ballast 65 and which can be filled with a ballasting material such as granular metal 67. The sausage-shaped containers 66 are each equipped with two upper and lower sealable openings, 66*a* and 66*b* respectively, in order to be able to introduce and remove the granular metal 67 and thus adjust the total weight of the ballast. In place of the sausage-shaped containers 66 and the granular metal filling 67, it is also possible to envisage placing means for anchoring pieces of metal such as ingots on either side of the fixed ballast 65.

When the trailer has a large capacity and is intended to transport a liquid, for example crude petroleum, which has a low specific gravity, the weight of the ballasting necessary to immerse it completely can reach values which are so high that it is then preferable only partially to immerse the trailer. It then proves necessary to protect the trailer against floating objects.

Figure 16:
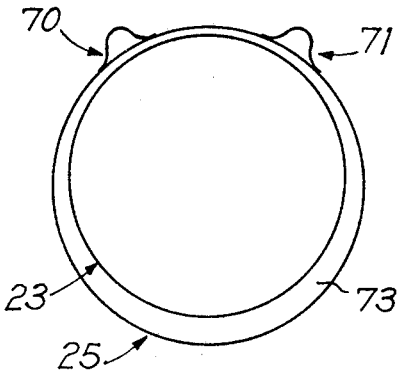
FIG. 16 is a cross-sectional view along the plane XVI of FIG. 15.
Figure 15:
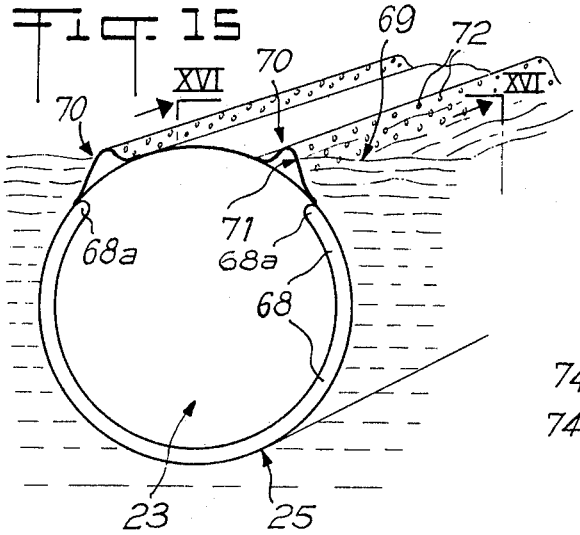
FIG. 15 is a partial diagrammatic view, in perspective, of a particular shape of the jacket for the trailer as illustrated in FIGS. 5 to 11.

This can be achieved, in the case of a trailer of FIGS. 5 to 11 described above, by giving the jacket 25 surrounding the container 23 the shape illustrated partially in perspective in FIG. 15, and in transverse cross-section in FIG. 16. The opening of the passage provided between the container 23 and the jacket 25 has at the front of the container, the shape of a crescent 68 whose upper ends or tips 68*a* are below the level 69 of the liquid medium through which the trailer is towed.

At the level of the flotation line 69 the trailer is equipped, along its entire length, with two protecting sheaths 70 which are made of flexible material and can be folded like bellows in the same way as the container 23, the reservoir 38 and their jackets 25 and 40, respectively. These sheaths each consist, on the one hand, of a longitudinal portion of the jacket 25, and on the other hand, of a strip 71 which is curved over transversely and attached, for example by welding, by its side edges to the outer surface of the jacket 25. These protecting sheaths have the shape of tubes which are open near the front and have orifices 72 with a relatively small cross-section provided over their entire length.

Protection of the trailer against the effects of impact with floating objects is achieved by the erection of the sheaths 70 by the entry of liquid therein via the front of the trailer. As is apparent in FIGS. 15 and 16, the space between the jacket 25 and the container 23 has a crescent-shaped transverse cross-section only in the front end portion of the trailer, and thereafter it reverts to an annular transverse cross-section 73 which decreases towards the back of the container 23, so as to provide the container 23 with protection over its entire periphery. The upper part of the annular space 73 is situated above the flotation line and has a restricted width so as to avoid too great an expenditure of energy in towing being devoted simply to pulling the liquid in this upper part. A similar shape is provided for the jacket 40 surrounding the reservoir 38.

It will be noted that the shape of the passage between the container 23 and the jacket 25, illustrated in FIGS. 15 and 16, can be produced simply by providing a space with a transverse cross-section such as 73 over the entire length of the container and by sealing the upper part of this space at the front of the trailer by means of a sealing plate, the position of which will be decided as a function of the degree of immersion of the trailer.

Figure 17:
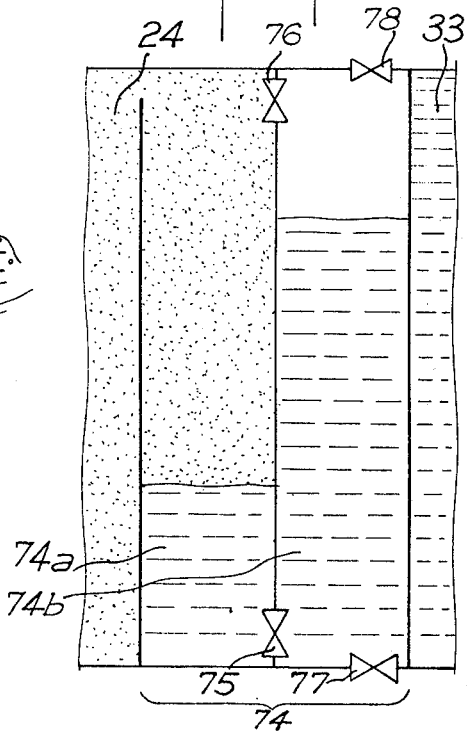
FIG. 17 is a diagrammatic view of a device to compensate for the expansion of the transported fluid.

FIG. 17 illustrates a device to compensate for the relative expansion of the cargo fluid, especially when this fluid has a density less than that of the liquid medium surrounding the trailer. Such a device proves advantageous only when the trailer has to be transported between two regions where very different temperatures usually prevail.

The device illustrated in FIG. 17 compensates for the relative expansion of the fluid compared with that of the wall of the container. It consists especially of an independent compensation reservoir 74 which is positioned, for example, adjacent to the water-ballast tank 33 and can be in fluid communication with the cargo fluid 24. The compensation reservoir 74 is partially filled with liquid and comprises two containers or columns 74*a* and 74*b* which can be brought into communication, at their lower part, by way of a valve 75, and at their upper part, by way of a valve 76.

The column 74*a* is filled with liquid surmounted by cargo fluid 24. The column 74*b* is partially filled with liquid surmounted by a mixture of air and the vapour of this liquid, and is equipped with a valve 77 at its lower part and with a valve 78 at its upper part, these two valves being able to establish communication between the column 74*b* and the exterior of the container. When it is necessary to compensate for the relative expansion of the transported fluid, for example during long voyages, the valves 75, 76 and 77 are opened an the valve 78 is closed, thus enabling equilibrium to be established between the two columns 74*a* and 74*b*. During short voyages, if such compensation does not prove useful, only the valve 75 is opened and the others are closed. In the event of damage to the container, a safety device closes all these valves to avoid the pollution hazards of loss of cargo liquid.

A similar compensation device can be positioned adjacent to the water-ballast tank 60 situated at the back of the safety reservoir or, in the case of the trailer of FIGS. 1 to 4, adjacent to the water-ballast tank 10. When the container of the trailer is divided into compartments, such compensation devices can be positioned in spaces provided between these compartments.

Although, in the Figures, trailers have been shown in which the container and, where appropriate, the reservoir, have the shape of a cylinder with a circular cross-section when they are unfolded, other shapes can be adopted and especially a cylinder with an elliptical or oval cross-section.

Other modifications can also be considered, without thereby going outside the scope of the invention claimed. For example, the reservoir associated with a container surrounded by a jacket as described in relation to FIGS. 5 to 11 may, instead of being also surrounded by a continuous jacket, be surrounded by tubular conduits, according to the first embodiment of the invention.

Finally, it is possible to surround the container and the reservoir of the trailer in the type of trailer illustrated in FIGS. 5 to 11 not with a single jacket but with several jackets which provide, between two adjacent jackets a space, for example an annular space, the cross-section of which decreases from the front towards the rear of the trailer. This makes it possible to increase, in successive stages, the pressure prevailing in the consecutive annular spaces separating the surrounding liquid medium from the container or from the reservoir. The pressure then acting on the wall of the container or of the reservoir is markedly higher than that of the surrounding liquid medium, and the protection of the reservoir is increased.

I claim:

1. A towable flexible marine trailer comprising an elongate container made of flexible material, and flexible walled conduit means externally of the container secured to and extending along said container; said conduit means having: a transverse cross section which decreases from the front towards the rear of said container, an open end near the front of said container and at least one outlet orifice remote from said open end and located in the rear portion of said conduit means so that, during towing of the trailer in liquid medium, said liquid medium can flow through said conduit means from said open end towards said outlet orifice and generate an internal pressure in said conduit means greater than the external pressure exerted by the surrounding liquid medium.

2. A trailer as set forth in claim 1, wherein said conduit means comprises a plurality of flexible-walled conduits extending along said container and equiangularly distributed around said container, said conduits being open at both ends and secured to the outer wall of the said container and each having its transverse cross-section decreasing from the front towards the rear of the said container.

3. A trailer as set forth in claim 1, wherein said conduit means comprises at least one jacket of flexible material surrounding the container, and delimiting together with said container an annular space which is open at both its ends in the vicinity of the front and of the rear of said container, said annular space having a transverse cross-section which gradually decreases from the front towards the rear of the container.

4. A trailer as set forth in claim 3 including discharge tubes for the liquid flowing through said annular space delimited by said container and said jacket and providing communication between said annular space and the exterior of said trailer, said discharge tubes defining the opening of said annular space in the vicinity of the rear of said container and having a shape such that the total cross section through which a liquid medium can discharge from the rear end portion of said annular space to the exterior is substantially constant.

5. A trailer as set forth in claim 3, wherein said annular space delimited by said container and said jacket has a crescent shape opening at the front end of the container which opening is only in that part of the container to be immersed in use of the trailer, and protecting sheaths extending longitudinally of said container above the ends of the said crescent, each of said sheaths consisting of a hollow tube defined on the one hand by a longitudinal portion of said jacket and on the other hand by a strip of flexible material which is curved over transversely and attached by its side edges to said jacket.

6. A trailer as set forth in claim 1, wherein said conduit means has an outer wall and rigidifying transverse rings of rigid material distributed along said conduit means.

7. A trailer as set forth in claim 1, and including adjustable ballast means distributed over its length at its lower part, said adjustable ballast means comprising sausage shaped containers firmly fixed to the outer wall of the trailer, and adapted to hold a ballasting material, and means defining at least one sealable opening in said container.

8. A trailer as set forth in claim 1, and including means to compensate for the relative expansion of a transported fluid compared with the expansion of the container holding said fluid, the said compensating means comprising: two compartments in said container adapted to communicate with one another, one of which is partially filled with liquid and communicates with the volume of transported fluid in said container, the other of said compartments being partially filled with liquid surmounted by gas; and means for communicating said other compartment with the exterior of said trailer.

9. A trailer as set forth in claim 3, and further including a safety reservoir of flexible material, means providing communication between said reservoir and said container, said communicating means comprising a conduit linking said container and reservoir, at least one valve in said conduit, pressure sensitive detection means on said trailer connected to said valve and responsive to a drop in pressure in said container for controlling the opening of the said valve in order to allow transfer of cargo fluid present in the container through the said conduit to the reservoir.

10. A trailer as set forth in claim 9, wherein said reservoir has a cross section larger than that of said container, and wherein a jacket surrounds said reservoir and delimits together with the reservoir an annular space which is open at both its ends in the vicinity of the front and of the rear of the reservoir, said annular space having a transverse cross-section which gradually decreases from the front towards the rear of said reservoir.

11. A trailer as set forth in claim 10, and including sealing means at least partially sealing that opening of the annular space which is at the front of the reservoir, and for freeing said opening under the control of the said pressure sensitive detection means.

12. A trailer as set forth in claim 9, wherein said pressure sensitive detection means comprise a plurality of manometers placed inside the container and in the said annular space defined between said container and said jacket.

13. A trailer as set forth in claim 9, wherein said reservoir is surrounded by further flexible walled conduit means extending longitudinally and externally of said reservoir; said further conduit means having a transverse cross section which decreases from the front towards the rear of said reservoir, an open end situated near the front of the reservoir, and at least one outlet orifice remote from said open end and located in the rear portion of said further conduit means.

14. A trailer as set forth in claim 9, wherein said container and said safety reservoir are each adapted to be folded like bellows and wherein at least one cable system extends over the length of the trailer and limits the same to a total length which is substantially constant during towing.

15. A trailer as set forth in claim 14, wherein said cable system comprises: attachment means secured to the rear end of the container, a first return pulley secured to the front end of the container and a second return pulley secured to the rear end of the reservoir, cable guiding rings positioned along and carried by the container and the reservoir, and a cable fastened at its ends to said attachment means, passing round said pulleys and extending twice along the reservoir and container through said rings.

* * * * *